US005776004A

United States Patent [19]

Wilson

[11] Patent Number: 5,776,004

[45] Date of Patent: Jul. 7, 1998

[54] PUTTING PRACTICE DEVICE

[76] Inventor: Thomas G. Wilson, 105 S. Porter St., Bolivar, Tenn. 98008

[21] Appl. No.: 706,254

[22] Filed: Sep. 4, 1996

Related U.S. Application Data

[63] Continuation of Ser. No. 423,468, Apr. 19, 1995, abandoned.

[51] Int. Cl.[6] ..... A63B 69/36

[52] U.S. Cl. ..... 473/179; 273/128 R; 273/126 R

[58] Field of Search ..... 473/179, 196; 273/128 R, 126 R

[56] References Cited

U.S. PATENT DOCUMENTS

| | | | |
|---|---|---|---|
| 4,280,698 | 7/1981 | Troiano . | |
| 4,728,106 | 3/1988 | Shore . | |
| 4,900,023 | 2/1990 | Gelina | 473/179 |
| 5,078,394 | 1/1992 | Kretz . | |
| 5,230,511 | 7/1993 | Gubany | 473/196 |
| 5,390,917 | 2/1995 | Mendoza . | |
| 5,415,397 | 5/1995 | Van Holt, Jr. | 473/179 |

*Primary Examiner*—George J. Marlo
*Attorney, Agent, or Firm*—Baker, Donelson, Bearman & Caldwell

[57] ABSTRACT

A putting practice device for inserting into a conventional golf hole to variably decrease the diameter of the hole. The putting practice device includes an outer ring-shaped member and an inner ring shaped member which have planar top and bottom surfaces. Both the outer and inner members define central holes having diameters which are smaller than the diameter of a conventional golf hole and greater than the diameter of a conventional golf ball. The inner member removably nests inside the central hole of the outer member. The outer side of the outer member is beveled at an angle of between 15 and 25 degrees to facilitate the insertion and secure alignment of the putting device within a conventional golf hole. The planar bottom surface of the putting device allows the device to be tapped over the turf of a putting green with a foot or golf club without snagging on the blades of grass.

5 Claims, 1 Drawing Sheet

PUTTING PRACTICE DEVICE

This application is a continuation of application Ser. No. 08/423,468 filed Apr. 19, 1995 which application is now abandoned.

BACKGROUND

The present invention relates generally to a device for helping a golfer improve his putting accuracy by temporarily reducing the size of a golf hole, and more specifically to a device for variably decreasing the size of a golf hole which is easily inserted and removed from the hole.

The putting greens on most golf courses are provided with holes which meet the specifications of the United States Golf Association ("USGA"). A standard USGA golf hole has a diameter of approximately 4.25 inches. Typically, the golf hole is provided with a cup which serves as a liner or retainer to preserve the integrity of the hole in the ground of the putting green. The cup may line the entire hole up to the edge of the turf of the green surrounding the hole or the cup may only line a portion of the hole, such as the lower half. Generally, each putting green on a golf course is configured to challenge the golfer, and the position of the hole on the green is changed regularly to continually offer the golfer new challenges. As a result, putting is a critical aspect of every golfer's game. A golfer can significantly improve his score by decreasing the number of strokes he must take to putt a golf ball into a golf hole. However, learning to control the golf ball so that it sinks into the hole with a minimum number of strokes is very difficult. Therefore, golfers are constantly looking for an inexpensive and easy to use device or technique which will assist them in controlling the ball and substantially reducing the number of strokes necessary to putt a ball into the hole.

One known technique used by golfers to improve the accuracy of their putting is to practice hitting the ball into a hole that has a smaller diameter than the diameter of a standard golf hole. Although attempts have been made to provide devices which reduce the size of a golf hole, these devices have several shortcomings. For example, one ring-shaped device is provided with pins extending radially from the surface. The pins must be manually retracted when aligning the device in a golf hole and then retracted again when removing the device from the hole. In a similar ring-shaped device, radially extending resilient teeth are provided which flex inwardly when the device is inserted into the hole. However, this type of device is easily dislodged when removing a ball from the hole. Also known is a very lightweight ring-shaped device which is provided with a flange extending straight down from the outer edge of the top surface. Due to the lightweight design, this device also must be manually inserted and adjusted and is easily dislodged from a golf hole.

All of these known devices are designed for use in a golf hole which is only partially lined by a cup. The pins and teeth of the previously described devices are designed to be inserted into the soil surrounding the golf hole. The pins and teeth can not secure the devices in a hole which is fully lined by a plastic or metal golf cup. The device with a flange can only be inserted in a hole which is partially lined with a cup. Moreover, none of the known devices can be adjusted to provide holes having variable diameters. A golfer must purchase a series of the previously described devices which have center holes with different diameters in order to provide the challenge of successively smaller holes. Since each putting green is different with various slopes and configurations, a golfer needs to practice aiming at decreasingly smaller holes under "real golf course conditions". In view of the amount of equipment normally carried by a golfer during a game, any device that decreases size of a golf hole be must be easy to carry around on the golf course. Golfers desire a device which can be dropped onto the ground and tapped into any standard golf hole with either a foot or a golf club. Also, a putting practice device should be easy to correctly position and secure within the hole without the need for repeated adjustments.

For the foregoing reasons, a need continues to exist for a simple, inexpensive device which variably reduces the size of a golf hole. A need also exists for a putting aid that is easily inserted, aligned within, and removed from a golf hole, and which is difficult to inadvertently dislodge from the hole during normal play.

SUMMARY

The present invention satisfies these needs by providing a simple, easy to use putting practice device which can be modified to gradually reduce the diameter of a golf hole as a golfer increases his putting skills. The design and weight of the putting practice device is such that the device can be easily inserted into a standard golf hole. Typically, the device can be installed into the hole by hand or placed on the turf of the green and tapped into the hole with a foot or golf club without the need for the golfer to bend over and make additional adjustments to align and secure the device in the hole. The present putting practice device is provided with at least two solid ring-shaped collars, a larger collar and a smaller collar. Each collar defines a center hole having a successively smaller diameter than the diameter of a standard golf hole. Generally, the outer diameter of the larger collar is substantially the same as the diameter of a standard golf hole. In a preferred embodiment, the outer diameter of the larger collar is slightly larger to provide a snug fit when the putting device is installed in a golf hole. For example, in a particularly preferred embodiment, the outer diameter of the larger collar is about 4.28 inches, while the diameter of a standard golf hole is about 4.25 inches. The outer diameter of the smaller collar is substantially the same as the diameter of the central hole in the larger collar so that the smaller collar nests snugly inside the larger collar. Both the larger outer collar and the smaller inner collar have generally planar top and bottom surfaces which are connected by annular outer and inner sides.

The outer diameter of the bottom surface of the larger outer collar is smaller than the outer diameter side of the larger collar so that the outer side of the larger collar is beveled at an angle of between about 20 and 25 degrees. This allows the present putting device to be easily aligned and secured in any standard golf hole without the need to continually adjust the device during play. Moreover, the beveled edge of the putting device facilitates the use of the device in a hole which may be fully lined by a plastic or metal cup.

When beginning putting practice, a golfer places only the larger collar in the golf hole. Preferably, the center hole in the larger collar reduces the diameter of a standard golf hole from about 4.25 inches to about 3.25 inches. As a golfer's putting skill increases, the smaller collar can be inserted within the larger collar to further reduce the diameter of a golf hole preferably from about 3.25 inches to about 2.5 inches. The putting practice device may be made of wood, rubber, plastic, or any other suitable material. However, the putting practice device is preferably molded of a solid ring of a polymer material, such as polypropylene. Preferably, the device has sufficient weight to prevent the device from tipping over when being urged across the turf on the green with a foot or golf club.

BRIEF DESCRIPTION OF THE DRAWINGS

These and other features, aspects and advantages of the present invention will become better understood when referring to the following description, appended claims, and accompanying drawings where:

DETAILED DESCRIPTION

Figure 1:
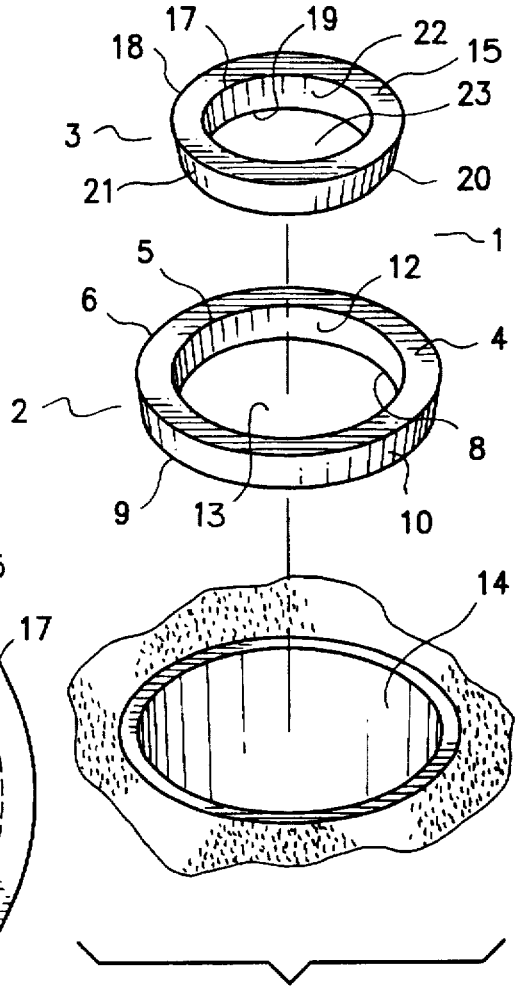
FIG. 1 is an exploded drawing embodying features of the putting practice device of the present invention.

Referring now to the drawings, there is shown is FIG. 1 an exploded view of the putting practice device 1 of the present invention. Putting practice device 1 is provided with at least two ring-shaped members, outer member 2 and inner member 3. The outer member 2 has a generally planar first top surface 4 with a first top inner rim 5 and a first top outer rim 6. Generally, the diameter of first top outer rim 6 is substantially the same as the diameter of a standard golf hole. However, preferably the diameter of the top outer rim 6 is slightly larger than the diameter of a standard golf hole to provide a snug fit when the putting device 1 is installed in the hole. Since the diameter of a standard golf hole is currently about 4.25 inches, in a particularly preferred embodiment, the top outer rim 6 of the present putting device has a diameter of about 4.28 inches.

The outer member 2 also has a generally planar first bottom surface 7 with a first bottom inner rim 8 and a first bottom outer rim 9. The first top outer rim 6 and the first bottom outer rim 9 are connected by a first outer side 10. The first top inner rim 5 and the first bottom inner rim 8 are connected by a first inner side 12. In a particularly preferred embodiment, the first outer side has a depth of between about 0.5 and 1.0 inches. The first top inner rim 5 and the first inner side 12 define a first annular center hole 13 having a diameter which is smaller than the diameter of a standard golf hole 14 but at least large enough to accommodate the passage of a conventional golf ball. In a particularly preferred embodiment, the first central hole 13 has a diameter of about 3.25 inches.

Figure 2:
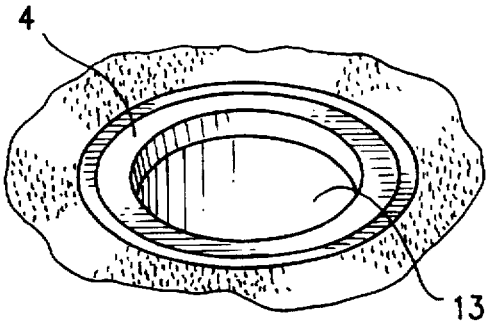
FIG. 2 is perspective view of the outer ring of the putting practice device installed in a golf hole.

As shown in FIG. 2, the first top surface 4, first bottom surface 7, and first outer and inner sides 10 and 12, respectively, form a first ring-shaped collar for use in reducing the size of the golf hole 14. The putting practice device 1 may be made of a polymer material, plastic, wood, rubber, or any other suitable material. Preferably, the putting device is formed as a solid ring having sufficient weight to allow a golfer to easily tap and align the putting device in the golf hole with a foot or golf club without repeatedly bending over. The planar closed bottom surface also allows the putting device to easily glide over the turf of a green without tipping over or snagging as a golfer taps the putting device toward a golf hole. In a particularly preferred embodiment, the putting practice device is molded from polypropylene or other non-compressible material. Depending upon the density and weight of the material from which the putting device 1 is formed, a number of small bore holes may be provided in the bottom surface 7 of the device in order to adjust the weight of the putting device 1.

Figure 3:
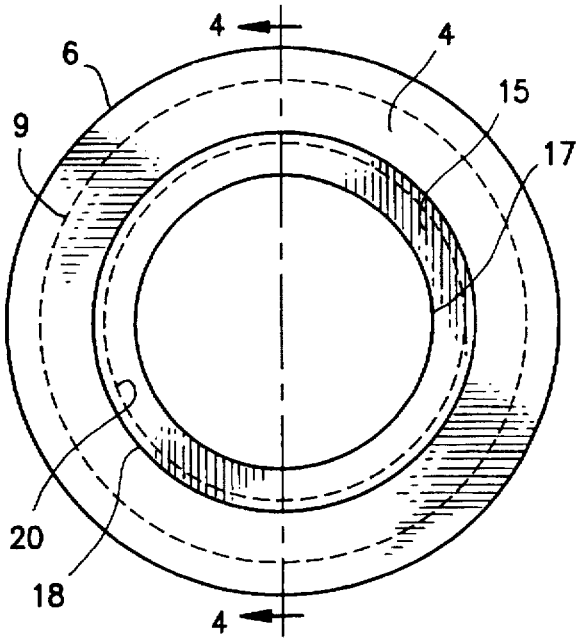
FIG. 3 is a top view of the putting practice device.

An important feature of the present invention is the degree to which the first outer side 10 angles inwardly to provide a beveled edge on the putting device 1. As illustrated in FIG. 3, the first bottom outer rim 9 has a diameter which is smaller than the diameter of the first top outer rim 6, providing a top outer side 10 which angles downward toward the center of the putting device 1. Preferably, the difference between the diameter of the first top outer rim 5 and the diameter of the first bottom outer rim 9 is such that the first outer side 10 slants inwardly toward the center of member 2 at an angle of between about 15 and 25 degrees. In a particularly preferred embodiment, the first outer side 10 angles inwardly at about 25 degrees. The beveled design of the first outer side 10 significantly facilitates the insertion and removal of the putting device 1 from any standard golf hole. Further, the beveled first outer side 10 allows the putting device 1 to be easily aligned and secured in golf hole which is either fully or partially lined by a plastic or metal cup. The beveled first outer side 10 also significantly reduces the likelihood that the putting device 1 will become dislodged as a golf ball enters or is removed from the hole.

Figure 4:
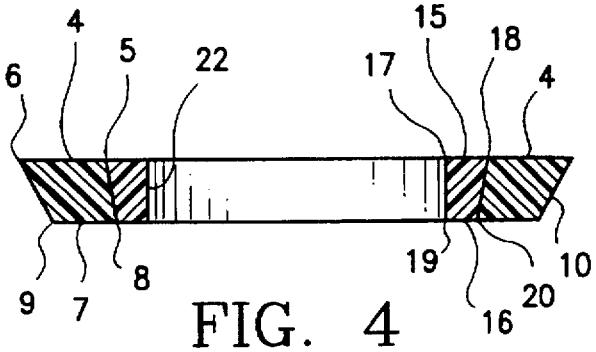
FIG. 4 is a cross-sectional drawing of the putting practice device taken along lines 4—4 in FIG. 3.

The putting device 1 also is provided with at least one ring-shaped inner member 3. As shown in FIGS. 1 and 4, the inner member 3 has a generally planar second top surface 15 , and a generally planar second bottom surface 16. The second top surface 15 has a second top inner rim 17 and a second top outer rim 18. The second bottom surface 16 has a second bottom inner rim 19 and a second bottom outer rim 20. The second top outer rim 18 and the second bottom outer rim 20 are connected by a second outer side 21. The second top inner rim 17 and the second bottom inner rim 19 are connected by a second inner side 22. The diameter of the second top outer rim 18 is substantially the same as the diameter of the second bottom outer rim 20. The diameter of the second top inner rim 17 is substantially the same as the diameter of the second bottom inner rim 19. The second top inner rim 17 and the second inner side 22 define a second annular center hole 23 having a diameter which is less than the diameter of the first annular central hole 13. In a particularly preferred embodiment, the diameter of second center hole 23 is about 2.5 inches. The second top surface 15, second bottom surface 16, and second outer and inner sides 21 and 22, respectively, form a second ring-shaped collar that nests inside the first central hole 13 of member 2 in such a manner that the second top surface 15 lies flush with the first top surface 4 to further reduce the diameter of a golf hole. While the putting device 1 is illustrated and described with two ring-shaped members to twice reduce the diameter of a golf hole, it is envisioned that any suitable number of nesting ring-shaped members may be provided in the putting device 1 to offer a golfer ever increasing challenges to his putting skills.

Figure 5:
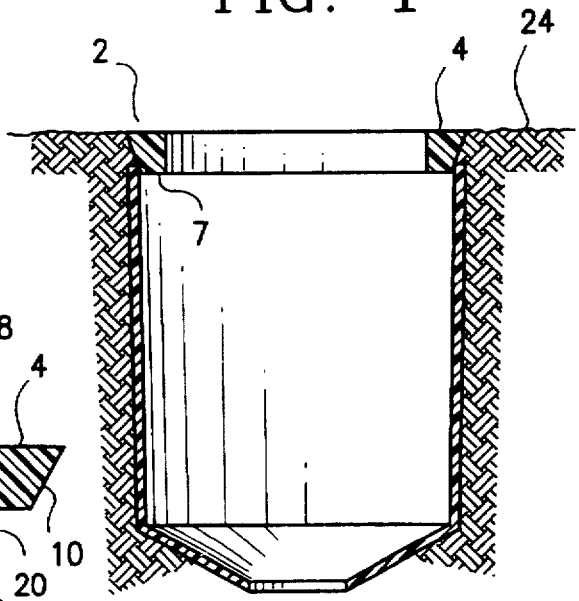
FIG. 5 is a cross-sectional side view of the putting practice device, showing the device installed in a golf hole.

To use the putting practice device 1, a golfer either inserts member 2 into a golf hole 14 by hand or drops the device onto the ground and taps the device over the turf of the green until the device is aligned over the hole. The putting device 1 is installed in the hole in such a manner that the first outer side 10 rests against the inside of hole 14. As shown in FIG. 5, the top surface 4 lies flush with the top edge of the golf hole and the surrounding turf. The golfer then attempts to putt a golf ball (not shown) into the first central hole 13. As the golfer's putting skills increase, the inner member 3 is inserted within the first central hole 13 of the outer member 2 to further reduce the diameter of the central opening 13.

Although the invention is described with respect to a preferred embodiment, it is expected that various modifications thereto may be made to the preferred embodiment without departing from the spirit and scope of the invention. Therefore, the scope of the invention is to be determined by reference to the claims which follow.

What is claimed is:

1. A device for reducing the diameter of a conventional golf hole which comprises:

a flat top planar surface in the shape of a circle having an outermost and an innermost diameter;

a bottom planar surface having an outermost and an innermost diameter, said bottom planar surface extending substantially parallel to the top planar surface, being spaced vertically therefrom and being generally coextensive in width with the top planar surface;

a truncated conically shaped outer sidewall which terminates at an upper end at the outermost diameter of the top planar surface and which terminates at a lower end at the outermost diameter of the bottom planar surface; and a vertically extending circular inner sidewall which terminates at an upper end in the top planar surface and which terminates at a lower end in the bottom planar surface, the top and bottom planar surfaces and the outer and inner sidewalls forming a ring-shaped member which defines a central aperture having a diameter which is greater than the diameter of a conventional golf ball, and the outermost diameter of said top planar surface being substantially the same as the diameter of a conventional golf hole and the outermost diameter of the bottom planar surface being sufficiently less than the outermost diameter of the top planar surface to bevel the outer sidewall inwardly toward the central aperture for fitting the golf hole, and the top planar surface defining a continuously flat rigid surface with the turf of the green so as to provide a continuous playing surface from the turf of the green, across the flat top planar surface, and into the golf hole through the central aperture, whereby a body of the ring-shaped member of the device defined between the top planar surface, the bottom planar surface, the circular inner sidewall and the truncated conically shaped outer sidewall being substantially rigid, non-compressible, dense and sufficiently weighted for allowing a golfer to easily tap and cause gliding of the body over the turf of a green without snagging or tipping over as a golfer taps the body with a foot or a golf club towards the golf hole.

2. A device according to claim 1 which further comprises a second ring-shaped member having a generally planar top surface, a generally planar bottom surface, an outer sidewall and an inner sidewall, said second ring-shaped member defining a second central aperture which has a diameter greater than the diameter of a conventional golf ball, and the outermost diameter of said outer sidewall of said second ring-shaped member being substantially the same as the diameter of the first central aperture in said first ring-shaped member.

3. A device according to claim 1, wherein the outer sidewall is beveled at an angle of between 15 degrees and 25 degrees.

4. A device according to claim 3, wherein the outer sidewall is beveled at an angle of between 20 degrees and 25 degrees.

5. A device according to claim 1, wherein the ring-shaped member is made of polypropylene.

* * * * *